US007963631B2

(12) United States Patent
Albertalli et al.

(10) Patent No.: US 7,963,631 B2
(45) Date of Patent: Jun. 21, 2011

(54) PRINTHEAD MAINTENANCE STATION

(75) Inventors: David Albertalli, Santa Clara, CA (US); Robert Taff, Brentwood, CA (US); Oleg N. Gratchev, San Jose, CA (US)

(73) Assignee: Ulvac, Inc., Kanagawa (JP)

( * ) Notice: Subject to any disclaimer, the term of this patent is extended or adjusted under 35 U.S.C. 154(b) by 908 days.

(21) Appl. No.: 11/912,228

(22) PCT Filed: Apr. 25, 2006

(86) PCT No.: PCT/US2006/015650

§ 371 (c)(1),
(2), (4) Date: Oct. 22, 2007

(87) PCT Pub. No.: WO2006/116415

PCT Pub. Date: Nov. 2, 2006

(65) Prior Publication Data

US 2008/0192089 A1 Aug. 14, 2008

Related U.S. Application Data

(60) Provisional application No. 60/674,584, filed on Apr. 25, 2005, provisional application No. 60/674,588, filed on Apr. 25, 2005, provisional application No. 60/674,591, filed on Apr. 25, 2005, provisional application No. 60/674,592, filed on Apr. 25, 2005, provisional application No. 60/674,590, filed on Apr. 25, 2005, provisional application No. 60/674,589, filed on Apr. 25, 2005, provisional application No. 60/674,585, filed on Apr. 25, 2005.

(51) Int. Cl.
*B41J 2/165* (2006.01)

(52) U.S. Cl. ..... 347/29; 347/28; 347/36

(58) Field of Classification Search ..... 347/20, 347/21, 22, 28, 29–37, 89–92, 8
See application file for complete search history.

(56) References Cited

U.S. PATENT DOCUMENTS

| | | | | |
|---|---|---|---|---|
| 3,839,721 | A | 10/1974 | Chen et al. | |
| 5,412,411 | A | 5/1995 | Anderson | |
| 6,585,348 | B2 * | 7/2003 | Reed et al. | 347/29 |
| 6,695,429 | B2 | 2/2004 | Barinaga | |
| 6,814,422 | B2 | 11/2004 | Bruch et al. | |
| 2004/0021726 | A1 * | 2/2004 | Obertegger et al. | 347/29 |

OTHER PUBLICATIONS

Supplemental European Search Report; Dec. 16, 2009.

* cited by examiner

*Primary Examiner* — Thinh H Nguyen
(74) *Attorney, Agent, or Firm* — Harness, Dickey & Pierce, PLC

(57) ABSTRACT

The present teachings relate to a printhead maintenance station for an industrial printing apparatus which is used to prevent clogging of the printhead, particularly during periods in which the printheads are idle. The maintenance station includes a capping station which has sockets for keeping the printheads moist and a blotting station for cleaning any residual printing fluids prior to carrying out a print function.

61 Claims, 10 Drawing Sheets

PRINTHEAD MAINTENANCE STATION

CROSS-REFERENCE TO RELATED APPLICATIONS

This application is a National Stage of International Application No. PCT/US2006/015650, filed Apr. 25, 2006, and claims the benefit of U.S. Provisional Application Nos. 60/674,584, 60/674,585, 60/674,588, 60/674,589, 60/674,590, 60/674,591, and 60/674,592, all filed on Apr. 25, 2005. The disclosures of the above applications are incorporated herein by reference.

BACKGROUND

The present teachings relate to a printhead maintenance station for a piezoelectric microdeposition (PMD) apparatus.

PMD processes are used to deposit droplets of fluid manufacturing materials on substrates without contamination of the substrates or the fluid manufacturing materials. Accordingly, PMD processes are particularly useful in clean room environments where contamination is to be avoided such as, for example, when manufacturing polymer light-emitting diode (PLED) display devices, printed circuit boards (PCBs), or liquid crystal displays (LCDs).

PMD methods and systems generally incorporate the use of a PMD tool, which includes a head to deposit fluid manufacturing materials on a substrate and a nozzle assembly including multiple independent nozzles. The PMD head is coupled with a computer numerically controlled system for patterning, i.e., precisely depositing droplets of the fluid manufacturing material onto predetermined locations of the substrate and for individually controlling each of the nozzles. In general, the PMD head may contain multiple printhead arrays and is configured to provide a high degree of precision and accuracy when used in combination with the various techniques and methods for forming microstructures on substrates.

Due to extremely high droplet deposition, positional accuracy typically required in PMD applications, and the use of ink jet fluids not typically used in graphics printers, maintenance methods previously employed in other fields of ink jet printing are often unsatisfactory for avoiding nozzle failure in PMD applications. Accordingly, there is a need for an improved device for maintaining the condition of the PMD head.

SUMMARY OF THE INVENTION

The present teachings include the use of a blotting station with precise dynamic control capability and single printhead interaction capability, a capping and priming station that offers several modes of nozzle maintenance operation and ink mist control, and a drop analysis system that sequentially interacts with a printhead array in an automatic fashion.

Another feature is the ability to configure a wiping action of the blotting station for different fluid and printhead types, as well as accommodating variables such as pressure, velocity, and vertical lift off during motion. The inclusion of a single blotting station apparatus within the blotting device to correct the failure of a single printhead is yet another aspect. A drop mist removal system integral to the capping station as part of waste removal to avoid contamination of the substrate being printed is also provided. Active Z movement of the printhead with respect to the maintenance system to optimize each of the functions used with respect to each fluid and printhead type is also considered to be unique.

Still another feature is the dynamic tracking system and the elements thereof used to maintain flatness and integrity of the blotting and wiping station, as well as the dynamic motion capabilities of the various elements of the maintenance station in relation to various elements such as a drop analysis and a drop check assembly of the PMD system.

Yet another feature of the present invention is the ability to fill localized fluid baths under each printhead with a solvent and bring the solvent to a precise distance from the nozzle plate of each printhead to cause a localized vapor-rich atmosphere to stop evaporation of the jetting fluid and density change within the PMD fluid. An appropriate material for the localized fluid bath structure is used so that a contact angle of the fluid to the structure of less than 20 degrees is also possible.

DESCRIPTION OF THE DRAWINGS

To further clarify the above and to demonstrate the advantages and features of the present teachings, a more particular description will be rendered by reference to specific embodiments thereof which are illustrated in the appended drawings. It is appreciated that these drawings are not to be considered limiting of the scope of the teachings. The teachings will be described and explained with additional specificity and detail through the use of the accompanying drawings in which.

DETAILED DESCRIPTION

Figure 1:
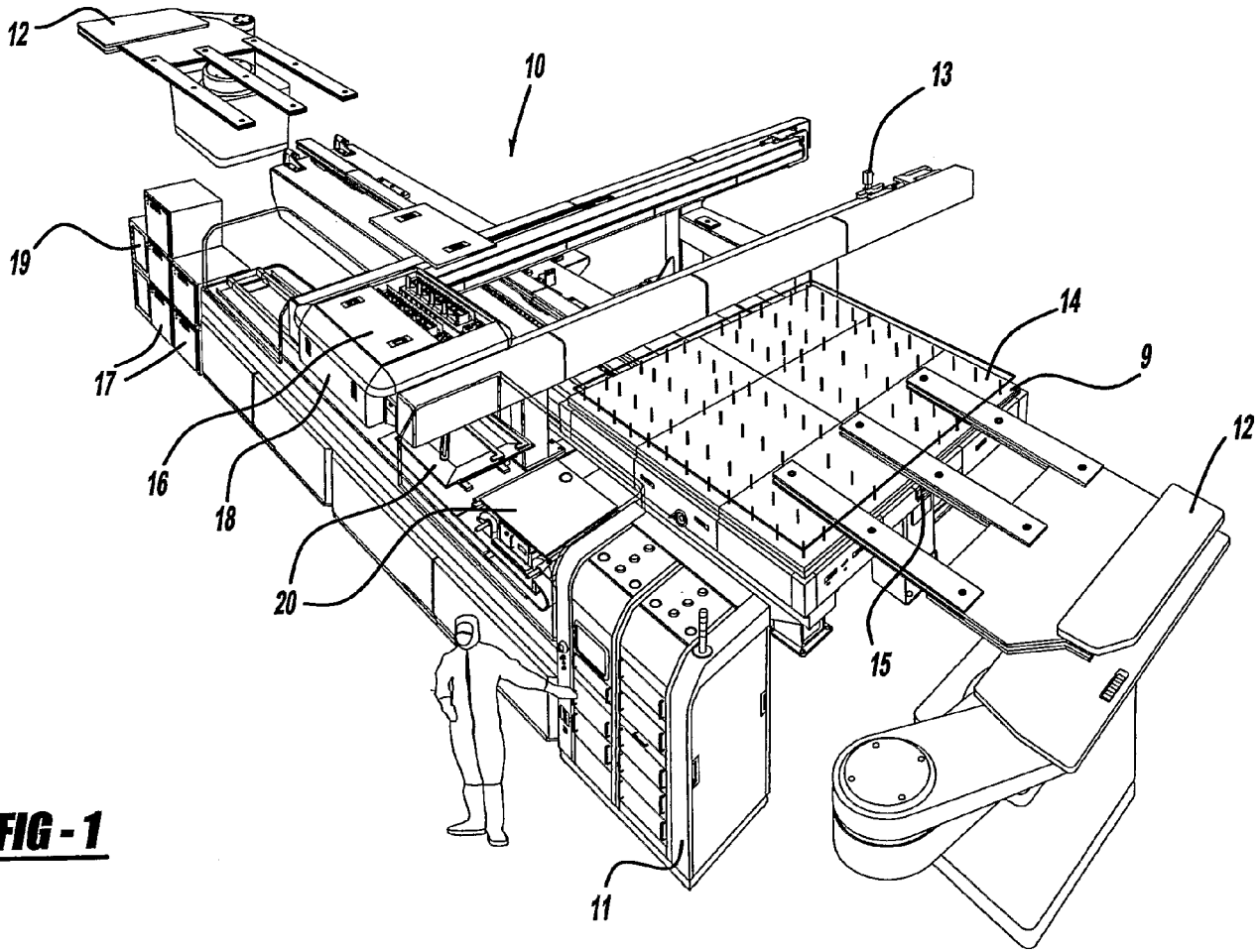
FIG. 1 is a perspective view of a piezoelectric microdeposition apparatus (PMD) incorporating the maintenance station of the present teachings.

The following description is merely exemplary in nature and is in no way intended to limit the teachings, its application, or uses.

The terms "fluid manufacturing material" and 'fluid material," as defined herein, are broadly construed to include any material that can assume a low viscosity form and that is suitable for being deposited, for example, from a PMD head onto a substrate for forming a microstructure. Fluid manufacturing materials may include, but are not limited to, light-emitting polymers (LEPs), which can be used to form polymer light-emitting diode display devices (PLEDs and PolyLEDs). Fluid manufacturing materials may also include plastics, metals, waxes, solders, solder pastes, biomedical products, acids, photoresists, solvents, adhesives, and epoxies. The term "fluid manufacturing material" is interchangeably referred to herein as "fluid material."

The term "deposition," as defined herein, generally refers to the process of depositing individual droplets of fluid materials on substrates. The terms 'let," "discharge," "pattern," and "deposit" are used interchangeably herein with specific reference to the deposition of the fluid material from a PMD head, for example. The terms "droplet" and "drop" are also used interchangeably.

The term "substrate," as defined herein, is broadly construed to include any material having a surface that is suitable for receiving a fluid material during a manufacturing process such as PMD. Substrates include, but are not limited to, glass plate, pipettes, silicon wafers, ceramic tiles, rigid and flexible plastic, and metal sheets and rolls. In certain embodiments, a deposited fluid material itself may form a substrate, in as much as the fluid material also includes surfaces suitable for receiving a fluid material during a manufacturing process, such as, for example, when forming three-dimensional microstructures.

The term "microstructures," as defined herein, generally refers to structures formed with a high degree of precision, and that are sized to fit on a substrate. In as much as the sizes of different substrates may vary, the term "microstructures" should not be construed to be limited to any particular size and can be used interchangeably with the term "structure." Microstructures may include a single droplet of a fluid material, any combination of droplets, or any structure formed by depositing the droplet(s) on a substrate, such as a two-dimensional layer, a three-dimensional architecture, and any other desired structure.

The PMD systems referenced herein perform processes by depositing fluid materials onto substrates according to user-defined computer-executable instructions. The term "computer-executable instructions," which is also referred to herein as "program modules" or "modules," generally includes routines, programs, objects, components, data structures, or the like that implement particular abstract data types or perform particular tasks such as, but not limited to, executing computer numerical controls for implementing PMD processes. Program modules may be stored on any computer-readable media, including, but not limited to RAM, ROM, EEPROM, CD-ROM or other optical disk storage, magnetic disk storage or other magnetic storage devices, or any other medium capable of storing instructions or data structures and capable of being accessed by a general purpose or special purpose computer.

Now referring to FIG. 1, a PMD apparatus including a maintenance station according to the present teachings is shown. The PMD apparatus 10 includes a pair of robots 12 that load and unload a substrate 14 onto a substrate stage 9 of the PMD apparatus 10. The use of the robots 12 assists in maintaining the substrate 14 in a clean condition such that foreign materials do not obstruct or damage surfaces of the substrate 14 that will be deposited with the patterned inks. The PMD apparatus 10 also includes an optics system that includes a pair of cameras 13 and 15 that assist in assuring that the substrate 14 is aligned in the PMD apparatus 10 properly.

The PMD apparatus 10 includes a system control/power module 11 that controls operation of the PMD apparatus 10. In this regard, operating parameters such as ink patterns, discharge speed, etc. may be controlled by an operator. Further, the system control/power module 11 also controls a printhead array 16 and a droplet inspection module of the PMD apparatus 10. The printhead array 16 includes various printheads (not shown) that deposit the inks onto the substrate 14.

Inks that are deposited by the printhead array 16 are supplied by ink supply modules 17. The ink supply modules 17 allow various types of inks suitable for different applications to be stored simultaneously. Also included in the PMD apparatus 10 is a solvent cleaning module 19. The solvent cleaning module 19 supplies solvents used to clean the printheads of the printhead array 16 to a maintenance station 20.

The maintenance station 20 may be positioned relative to the printhead array 16 and the substrate stage 9 such that all maintenance functions can be executed (i.e., purging, soaking, priming, capping, blotting, wiping, and drop inspection through the optical system) while the substrate loading, alignment, and unloading are being performed. System throughput may be enhanced as this arrangement allows identification and correction of a jetting problem in parallel with normal operations of the machine without affecting their sequence.

Figure 2:
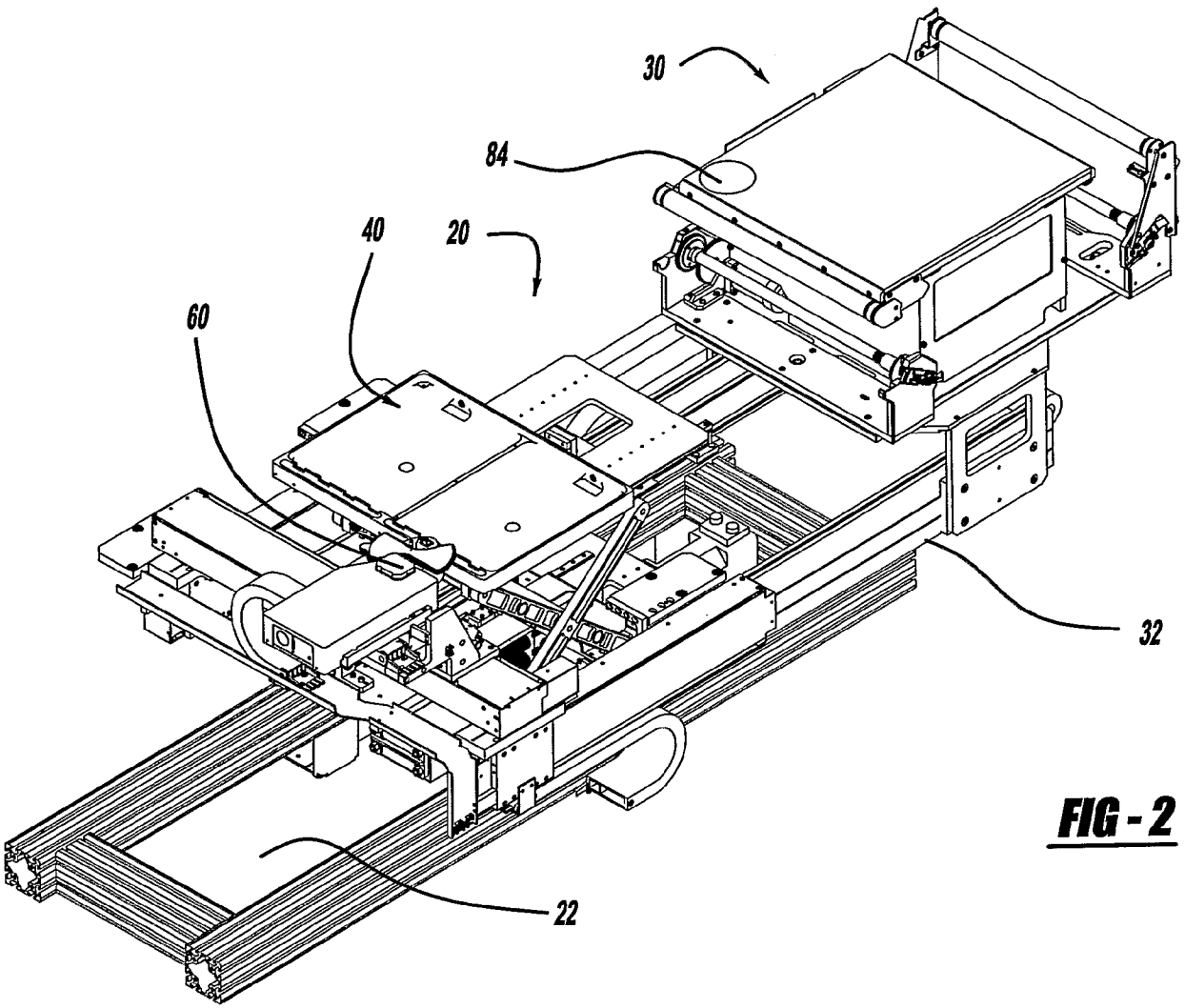
FIG. 2 illustrates a perspective view of one embodiment of the maintenance station of the PMD apparatus.
Figure 3:
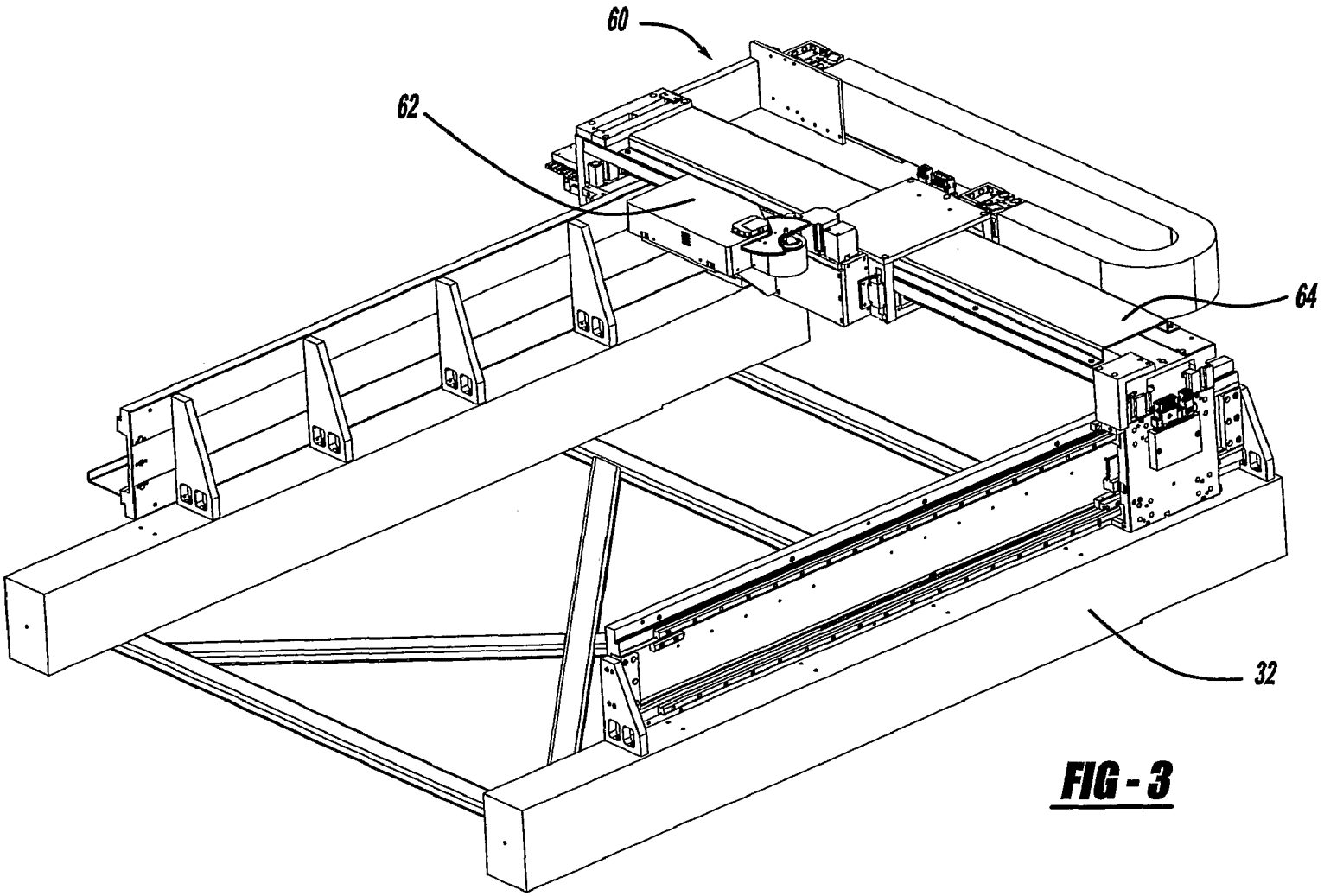
FIG. 3 illustrates the drop analysis system sub-assembly of the PMD apparatus that, by motions of a capping station and tray, allows for drop analysis in association with the maintenance station for the PMD apparatus.

Now referring to FIG. 2, the maintenance station 20 may be used to maintain proper printhead jetting and cleanliness of the printheads 34. The maintenance station 20 includes a translation stage 22 for positioning various modules of the maintenance station 20 under the printhead array 16. The modules of the maintenance station 20 include a blotting station 30 and a capping station 40. Associated with the capping station 40, as shown in FIG. 2, is a drop analysis system 60, which is described in co-pending U.S. Provisional Application No. 60/674,589, entitled "Drop Analysis System" and hereby incorporated by reference. The drop analysis system 60 includes a vision system 62 movably mounted to a stage 64 having x-, y- and z-axis motion capabilities as shown in FIG. 3. The drop analysis stage 64 is in turn mounted to a frame member that is part of a larger substrate, camera system, and printhead translation stage system that has x- and y-axis movement capabilities.

Figure 2A:
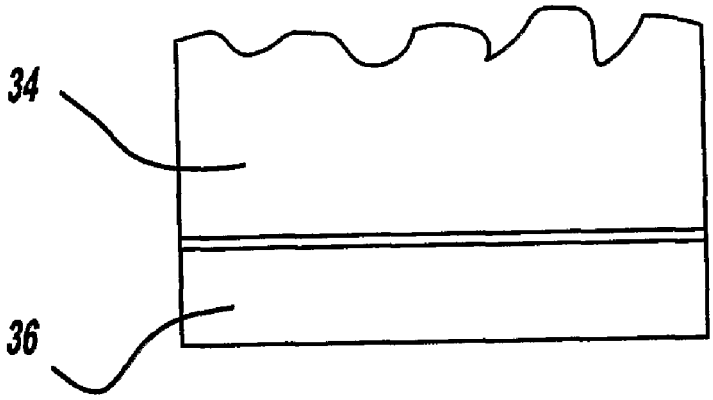
FIG. 2A illustrates a nozzle plate and a printhead.

The capping station 40, which provides for capping the printhead nozzle plate 36 (FIG. 2A) when not in use, idle, or when lowered sufficiently to allow for drop analysis or drop check to occur, is generally operable in three positions. Namely, a vapor immersion position where printheads 34 can be positioned just above the solvent to provide a vapor rich atmosphere, a liquid immersion position where the printheads 34 are to be inserted into a solvent, and a fluid purging position where the capping station 40 is lowered slightly below the vapor immersion position. The head array z-axis can be used to control the vapor immersion and liquid immersion positions, while movement of a scissor-lift mechanism or movement of the printhead array 16 in combination with translation of the lower maintenance support stage 32 controls the third position, described below.

By movement of the lower maintenance system support stage 32 relative to the printhead array 16, capping inserts 50 (see FIGS. 4A-4D) that can be refilled with clean-filtered solvent of the appropriate type can be positioned in a second taught position when purging old jetting fluid through the nozzle array so as not to contaminate the capping solvent. Movement of the printhead array 16 with the associated printheads 34 is described in more detail in co-pending U.S. Provisional Application No. 60/674,590 entitled "Printable Substrate Alignment System," which is hereby incorporated by reference. Each of the three positions ensures that the nozzle plate 36 stays moist when not in use, or idle, which prevents clogging of the nozzle plate 36 and ensures better performance.

Figure 4A:
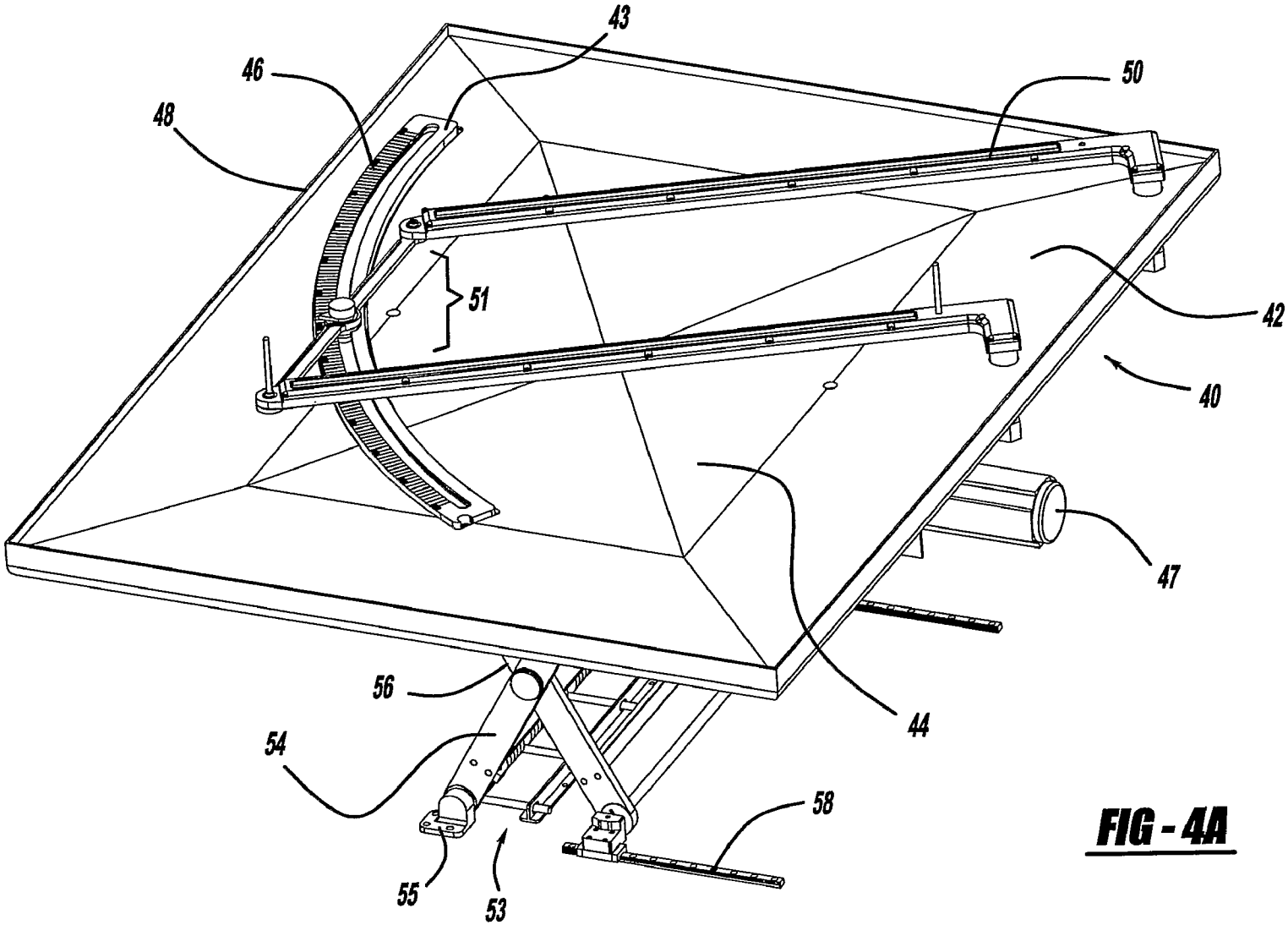
FIG. 4A is a perspective view of an embodiment of a capping station according to the present teachings.

Now referring to FIG. 4A, it can be seen that the capping station 40 includes an insert 46 that is spaced away from the bottom plate 44 of tray 42 along at least one side 48 to provide a gap 51. As shown in FIG. 4A, the insert 46 includes a positioning track 43 that allows for the capping inserts, also known as solvent baths 50, to be moved through various angles to correspond to positions relative to the printheads 34 of the printhead array 16. The position of the solvent baths 50 is moved through the positioning track 43 by motor 47. Motor 47 is controlled by the system control/power module 11.

Figure 4B:
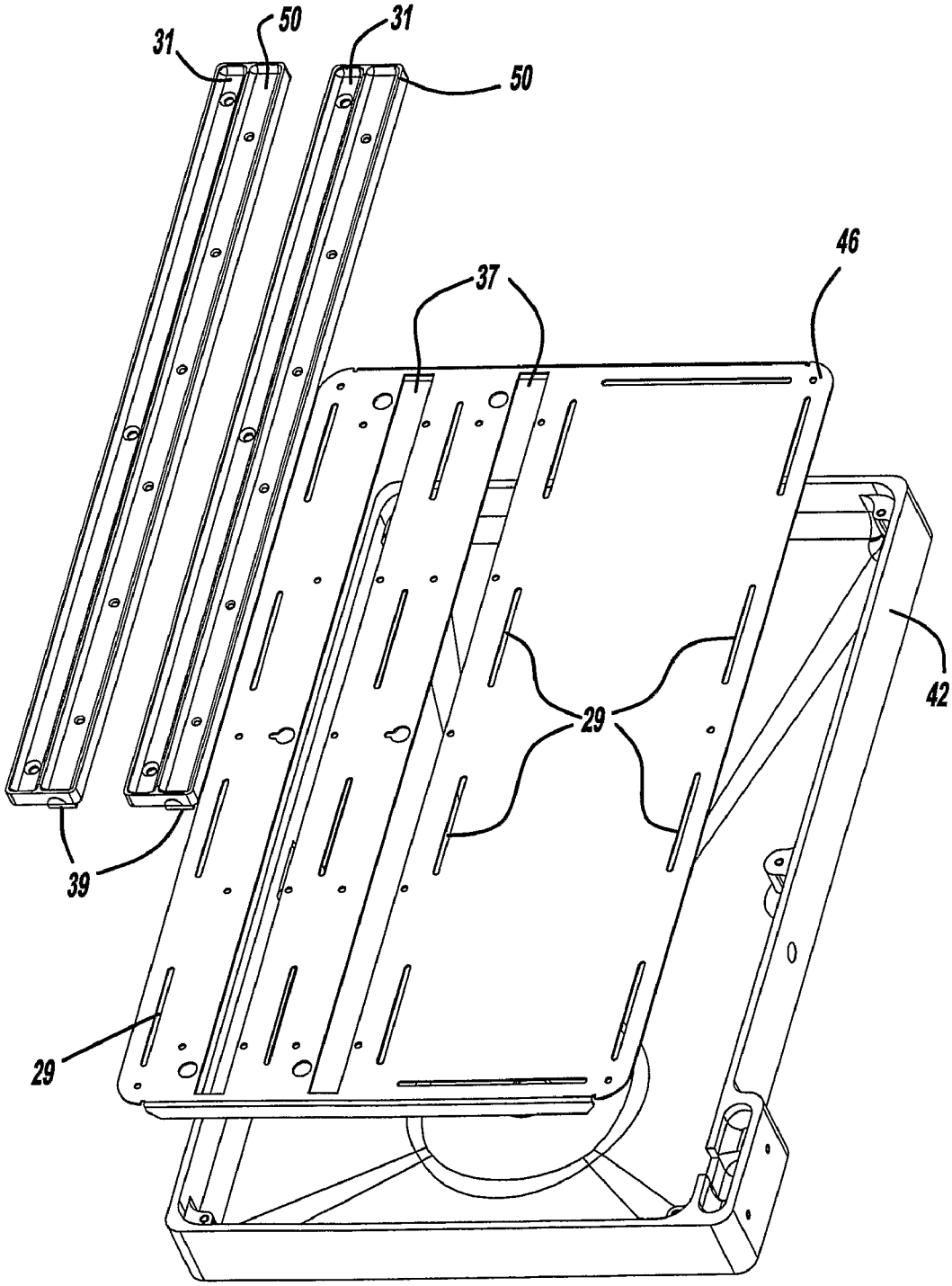
FIG. 4B is an exploded perspective view of a tray used in an embodiment of the capping station according to the present teachings.
Figure 4C:
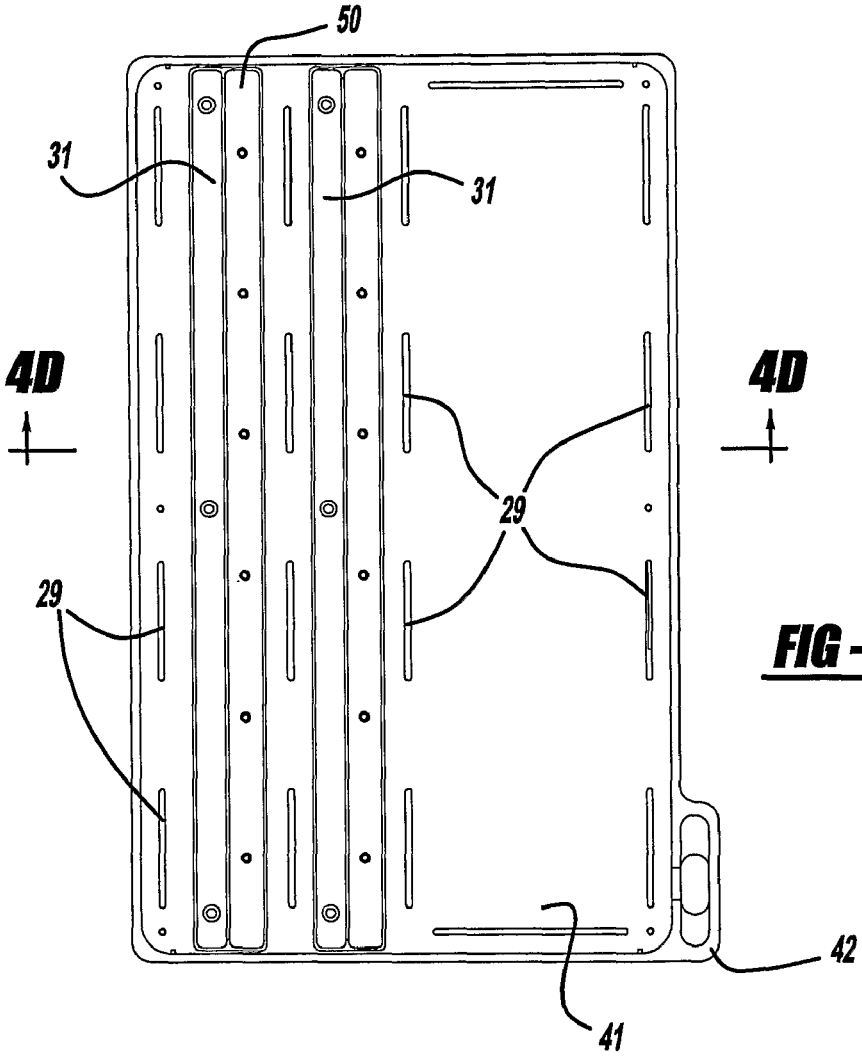
FIG. 4C is a top view of an embodiment of a tray used in an embodiment of the capping station according to the present teachings.
Figure 4D:
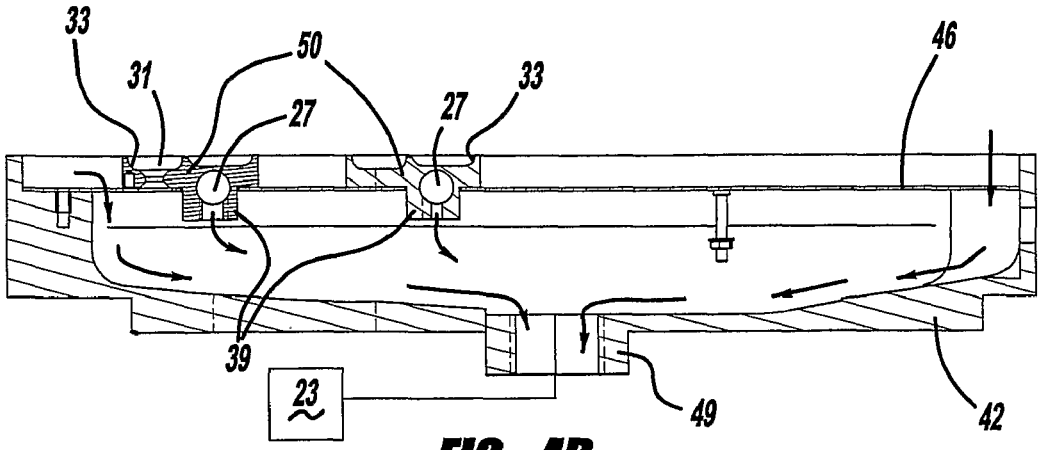
FIG. 4D is a cross-section view of the tray depicted in FIG. 4C.

Although the solvent baths 50 of insert 46 may be designed to be movable through various angles, the insert 46 can also be designed such that solvent baths 50 are immovable. It should be understood that with this approach, either the printhead array 16 can be pitched to the immovable, fixed positions of the solvent baths when the heads require maintenance or, in some PMD applications, a fixed print angle head array may be used. Referring to FIGS. 4B to 4D, it can be seen that tray 42 may include a design where insert 46 is a plate that includes slots 37 that are engageable with the solvent baths 50. That is, the solvent baths 50 are configured to include tabs 39 (see FIG. 4D) that engage with slots 37. In this design, solvent baths 50 and insert 46 are adapted to allow for drainage into tray 42. In this manner, the solvent of solvent baths 50 may be frequently, or even continuously, drained and refreshed. To refresh the solvent, solvent baths 50 are fed by a solvent manifold 27 that is connected to solvent modules 17. Further, to dispose of used solvent, tray 42 is equipped with a drain 49 (see FIG. 4D) and drain line (not shown) that leads back to solvent modules 17. The drain 49 and drain line may be connected to a high flow vacuum pump to evacuate not only the liquid waste, but also the fumes above the capping station 40, and to minimize possible side airflow during drop analysis.

In either design, it should be understood that solvent baths 50 are designed to be a size that allows +/−1.5 mm head clearance to minimize solvent evaporation when the head is capped. Further, the gap 51 enables use of a vacuum mechanism 23, which may evacuate vapors produced by the standing solvent pools to protect clean room integrity. A secondary and equally important function of the vacuum system 23 is to capture floating ink droplets from printheads 34 during halt and fire operations, discussed below. The solvent baths 50 also may include edges 33 that are chamfered (FIG. 4D) to reduce the effect of non-wetting of the trough material with solvent. Lastly, it should be understood that although only a pair of solvent baths 50 are shown in the drawings, any number of solvent baths 50 may be used as required. For example, depending on the number of printheads 34, each printhead 34 may have a corresponding solvent bath 50 in capping station 40.

The capping station 40 is also equipped with a device to adjust the height and level of the module in the PMD apparatus 10. As shown in FIG. 4A, the height adjustment means 53 incorporates a scissor-lift system 54 to allow the module to raise and lower. The scissor lift 54 includes a pair of cross-bars 56. One of the cross-bars 56 is fixed at one end to a base 55, while the other of the cross-bars 56 is movably attached along another end to lift tracks 58.

By raising and lowering the capping station 40 as necessary, interference with the movement of other modules can be avoided. For example, the height adjustment device 53 enables the capping station 40 to be lowered to a position such that drop analysis system 60 is enabled to be moved along the translation stage 22 to be disposed over capping station 40. That is, the capping station may be raised and lowered by the height adjustment device 53 to provide clearance for the vision system 62 of the drop analysis system. Further, such movement assists in the positioning of the capping station solvent baths 50 accurately in relation to the printheads 34. For example, the capping station 40 can be positioned so that the printheads 34 are in a vapor immersion position, solvent immersion position, or waste removal position, as described above.

As stated above, the vapor immersion position of the capping station 40 positions the solvent baths 50 such that the printheads 34 are positioned directly above the solvent located in the solvent baths 50. In such a position, the printheads 34 are suspended over the solvent baths 50 at a distance of 0.5 mm. It should be understood, however, that any distance that satisfactorily immerses the printheads 34 in solvent vapor is acceptable. In this regard, the distance can be determined depending on the type of ink being used. For example, a more viscous ink may require the printhead 34 to be suspended more closely to the solvent baths 50 such that the printhead 34 is subjected to a higher concentration of solvent vapor. In contrast, a less viscous ink may enable the printhead 34 to be suspended further from the solvent bath 50, as a lower concentration of solvent vapor is needed to clean the nozzles in the printhead 34.

Regardless of the distance away from the solvent baths 50, the nozzles of the printhead 34 may be spot fired at any frequency from 1 Hz to 1000 Hz by software control that is selected and stored by the user to occur when substrate printing is not active to further eliminate drying of the ink in the printhead 34. At such a frequency, a minimal amount of ink is discharged in a manner that prevents agglomeration of particles within the printhead 34 for some ink types and deters air bubbles from developing in the nozzle, while still allowing the solvent vapor to inhibit drying of the inks on the face of the nozzle plate 36 to a point where normal blotting and wiping cannot remove the material.

In contrast to the vapor immersion position of the capping station 40, the liquid immersion position of the capping station 40 fully immerses the nozzles of the printhead 34 into the solvent located in the solvent baths 50. By immersing the printhead 34 into the solvent, the printheads 34 do not need to be spot fired to reduce the risk of air bubbles developing in the nozzles of the printhead 34 and deposits that may have built up on the nozzle surface from ink mist can naturally dissolve or soften from extended immersion, followed by a routine wiping action to renew the nozzle plate surface.

In the fluid purging position, the capping station 40 is lowered using the scissor-lift mechanism 54 to a position that is slightly lower than the vapor immersion position. In combination with movement of the lower maintenance support stage 32, up to a 15 mm horizontal movement of the capping station 40 relative to the head array may be effectuated. In this manner, the nozzles may be positioned over a waste trough 31 that runs substantially parallel to the solvent baths 50 such that waste ink discharged by the nozzles will not be deposited into the solvent baths 50, which are filled with clean solvent. At this position, the nozzles may be spot-fired in the same manner as the vapor immersion position to discharge a minimal amount of ink, while still being cleaned in a vapor-rich atmosphere. In this position, however, the ink is discharged into the waste troughs 31 and insert 46, which includes slots 29. Because the capping station may be connected to a vacuum mechanism 23 that runs continuously, the waste ink may be drawn into tray 42 and through the drain 49 as shown in FIG. 4D.

Another embodiment of the capping station 40 uses a four-bar lift mechanism to raise and lower the capping station 40. This design uses a series of solvent baths 50 that are fixed for fixed pitch printhead arrays.

Figure 5A:
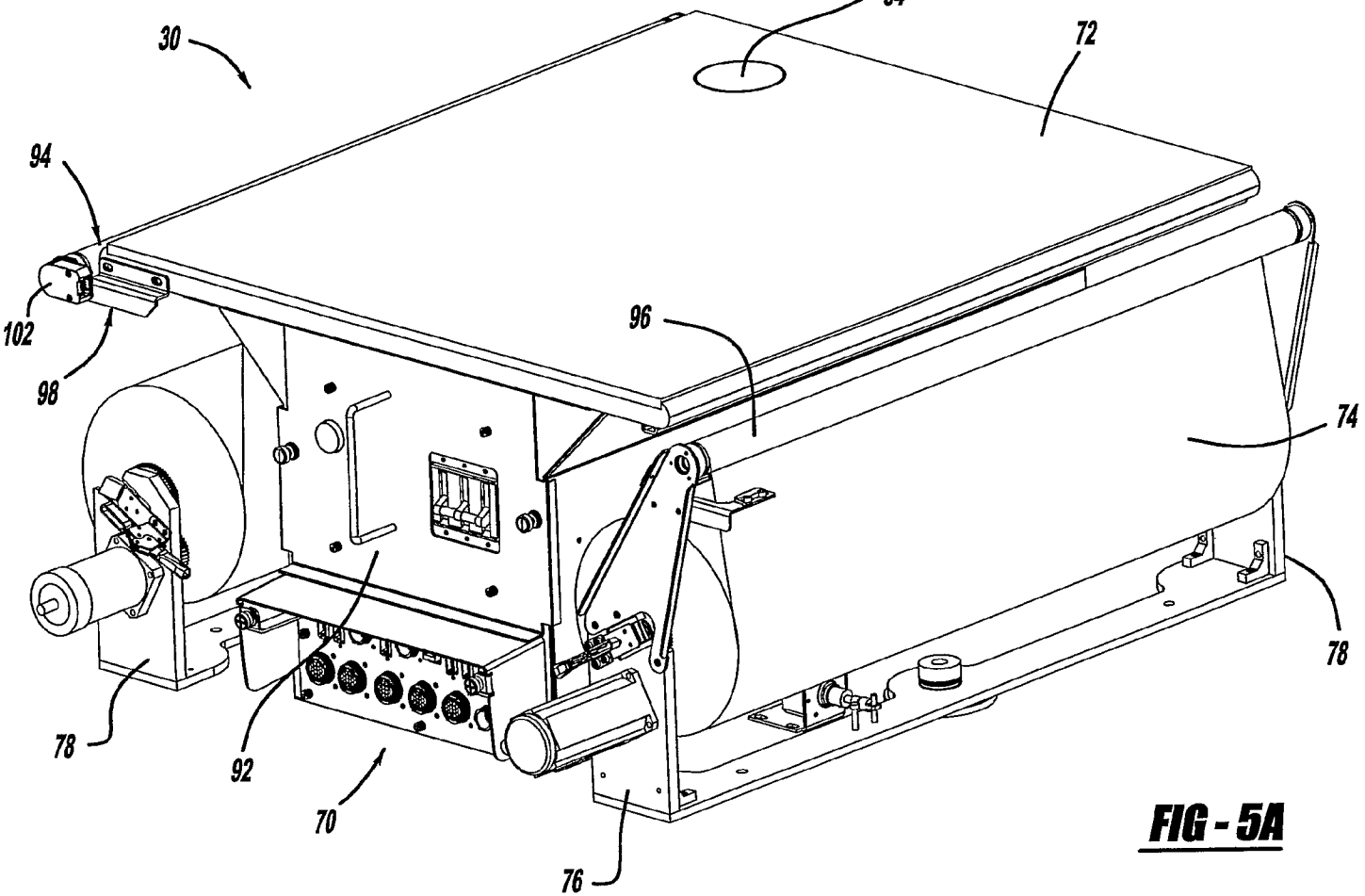
FIG. 5A illustrates a perspective view of a blotting station according to the present teachings.

Now referring to FIG. 5A, the blotting station 30 absorbs excess solvent or printing fluid from the print nozzle plates 36 of the printheads 34 by contacting the printheads 34 with a blotting material 74. Blotting is used for both recovery of blocked nozzles, and routine maintenance of nozzle plates 36. The blotting station 30 generally includes a base 70 which is mounted to the platform 32, as shown in FIG. 2.

Figure 5B:
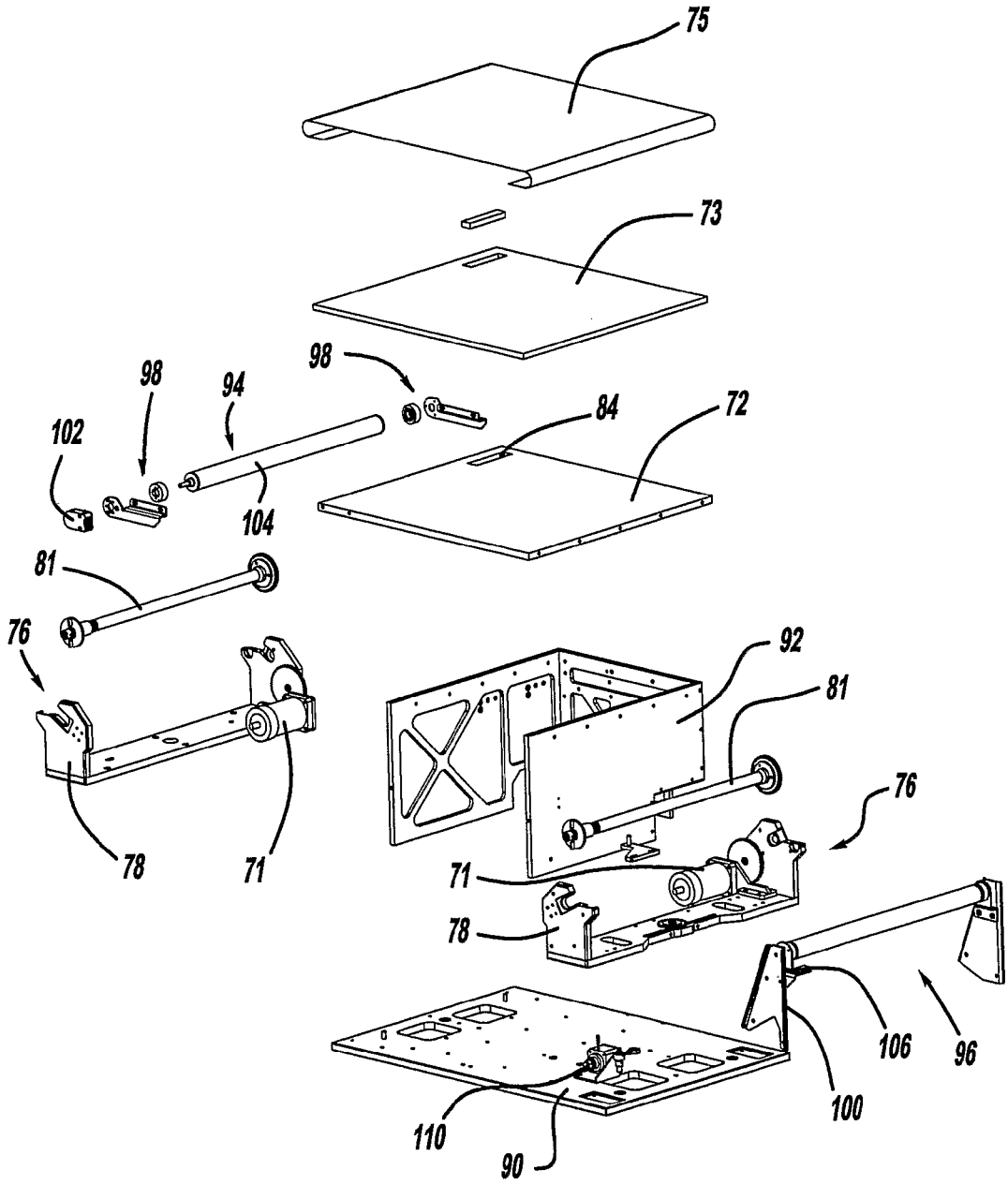
FIG. 5B is an exploded perspective view of the blotting station according to the present teachings.

Base 70 is comprised of a base plate 90 (see FIG. 5B) and housing 92. Extending from the top of the base 70 is a supporting plate 72 over which the blotting material 74 is fed via servo controlled feed motors 71. A pop-up section 84 in the supporting plate 72 may be incorporated to allow blotting of a single printhead 34. Supporting plate 72 may be formed of aluminum, or any material known to one skilled in the art. Further, supporting plate 72 is covered by a padding 73 and thin sheet 75 of polytetrafluoroethylene (PTFE) to protect the padding 73 and to allow for the blotting material 74 in concert with dried or drying jetting fluids to release from the surface of supporting plate 72 after periods of non-use.

The blotting material 74 may be supplied as a roll that is held by support roller assemblies 76 that include brackets 78 and rollers 81. The blotting material 74 is held at a constant tension force by supply and take-up roller assemblies 94 and 96. Supply roller assembly 94 is attached to supporting plate 72 via bearing assemblies 98. Take-up roller 96 assembly is supported by a support bracket 100 that is attached to bracket 78 of one of the support roller assemblies 76.

The blotting material 74 is preferably held at a constant tension force, even when the blotting material 74 is advancing during a wiping function. The required tension is a function of the particular material and size thereof and can be set and stored through the system control/power module 11. The desired tension is achieved by pulling with the take-up roller assembly 96 and holding back with the supply roller assembly 94 until an error of a sufficient magnitude that is equal to the desired tension of the web is sensed by a motion controller system that includes a supply roller motor/encoder 102.

As the diameter of the two rolls changes, the magnitude of the error is adjusted on the supply roller assembly 94 to reflect that a decrease in the applied torque by the servo motor 71 on the supply roller assembly 94 side of the blotting station 30 is needed to sustain the constant tension as the roll size increases on the take-up roller 96 side of the blotting station 40. The roll size is determined by a relationship between an encoder (not shown) that is provided in the servo motor 71 on the supply roller assembly 94 side of the blotting station 30 and the encoder 102 on the fixed diameter linear feed encoder shaft 104 of the supply roller assembly 94.

Shaft 104 is preferably formed of aluminum, sandblasted, and then anodized to provided a sufficiently roughened surface that prohibits slip of the blotting material 74 against its surface, such that linear motion of the blotting material 74 always has a constant relationship to the number of encoder counts that are generated by the rotary optical encoder 102 attached to this shaft 104. If the supply roll is new and at its largest diameter, very few encoder counts will be generated by the encoder in the servo motor 71 on the supply roller assembly 94 side of the blotting station 30 relative to the linear feed encoder roller optical encoder 102. If the supply roll is almost depleted, representing a much smaller diameter, the number of encoder counts on the encoder in the servo motor 71 will be proportionately larger based on the ratio of diameters. As such, it should be understood that the linear feed encoder roller encoder 102 output is important to the function of the system in maintaining constant web tension leading to the correct compliance of the blotting material 74 cloth relative to the nozzle plate 36 and elimination of wrinkles in the cloth due to extreme tension.

Figure 5C:
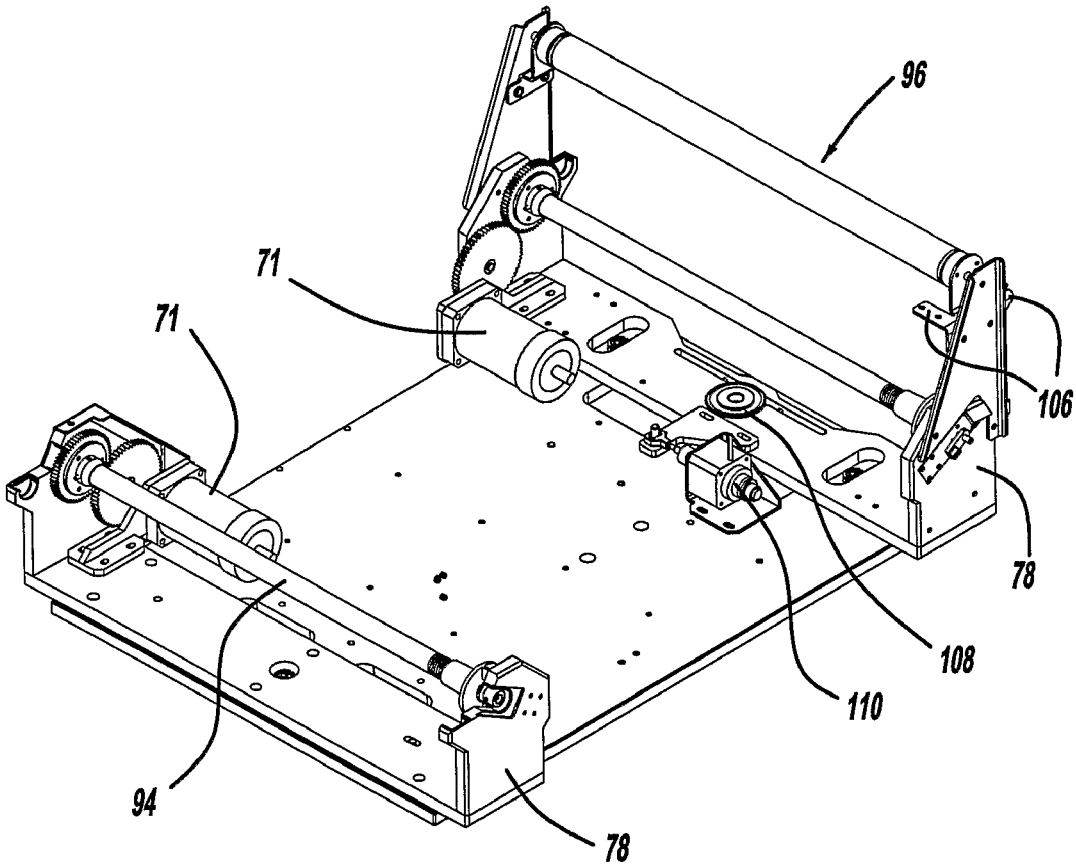
FIG. 5C is a perspective view of various elements of the blotting station according to the present teachings.

An edge sensor 106, shown in FIG. 5C, may be incorporated to monitor cloth tracking errors and provide feedback to an angular adjustment actuator 108. The angular adjustment actuator 108, in proportion to the tracking error indicated by the edge sensor 106, introduces a slight distortion in the tension across the blotting material web 74 by rotation of the take-up roller assembly 96 and the linear feed encoder roller 104. This distortion causes a reaction force in the web 74 that tracks the material in a direction opposed to the error detected. The edge sensor 106 has a range of 10 mm to sense movement, and a dead band of 1 mm is established in the center of this range. No corrections will be made as long as the blotting material 74 is in the dead band region. Should it go outside the dead band region, an angular correction is made by using a steering motor 110 to drive the angular adjustment actuator 108 and the blotting material 74 is returned to its home position within 100 ms of the cloth re-entering the dead band region. The amount of angular correction is also determined by the velocity of the tracking error as the blotting material 74 leaves the dead band region.

The design of the blotting station module 30 also allows a vacuum hood (not shown) to be implemented because it may be required to have fume evacuation from near the blotting material rolls and table. Further, the blotting station may be positioned in a secondary containment tray that protects other modules from accidental fluid spills.

As stated above, pop-up section 84 allows for the cleaning of a single printhead. The pop-up section 84 may be a through-hole formed in support plate 72 that is in fluid communication with an air cylinder (not shown). Pop-up section 84 is covered by the padding and PTFE sheet that covers plate 72.

As the pop-up section 84 is in fluid communication with an air cylinder, when air is blown through pop-up section 84, the padding and PTFE sheet "pops up" to a height of 0.5 to 1.0 mm above the surrounding surface such that only a single printhead of interest will contact the blotting material in this area. The printhead array 16 will then move to a second taught Z position that allows precise contact of the target printhead with the popped-up section of blotting material 74. This Z position is set to accommodate the exact pop-up height mentioned above.

The printhead 34 may penetrate against the blotting assembly no more then 0.2 mm+/−0.05 mm to achieve intimate contact without causing undue wear on the nozzle plate surface 36 during wiping. The maintenance translation stage 22 in concert with the printhead array motion controller can locate any printhead 34 from a large array of printheads 34 at this singular location. Thus, while only the defective printhead is serviced, thereby reducing use of blotting material 74 and ink, no negative effects are experienced by printheads 34 that are functioning within specified parameters. In this manner, a single printhead 34 may be cleaned independently of the other printhead ink jet array 16.

The description is merely exemplary in nature and, thus, variations are not to be regarded as a departure from the spirit and scope of the teachings.

What is claimed is:

1. A printing apparatus comprising:

a printhead for depositing printing fluid onto a substrate;

a stage onto which the substrate is loaded and unloaded;

a maintenance station for the printhead that includes a capping station and a blotting station, wherein the maintenance station is configured to operate while the substrate is being at least one of loaded and unloaded;

a height adjustment device that supports one of the capping station and the blotting station; and a drop analysis system, wherein the height adjustment device positions at least one of the capping station and the blotting station relative to the drop analysis system.

2. The printing apparatus of claim 1 wherein the height adjustment device includes a scissor lift mechanism.

3. The printing apparatus of claim 1 wherein the capping station provides for an immersion position and a waste removal position of the solvent bath with respect to the printhead.

4. The printing apparatus of claim 3 wherein the printhead is directly above the solvent bath in the immersion position.

5. The printing apparatus of claim 3 wherein the printhead is laterally displaced with respect to the solvent bath in the waste removal position.

6. The printing apparatus of claim 5 wherein the printhead is immersed in solvent vapors from the solvent bath in the waste removal position.

7. The printing apparatus of claim 3 further comprising a tray that captures waste fluid from the printhead.

8. The printing apparatus of claim 7 wherein the waste fluid includes the solvent.

9. The printing apparatus of claim 7 wherein the waste fluid includes the printing fluid.

10. The printing apparatus of claim 7 further comprising a vacuum mechanism that extracts the waste fluid.

11. The printing apparatus of claim 10 wherein the printhead is spot-fired at a frequency in the range of 1 to 1000 Hz in the waste removal position.

12. The printing apparatus of claim 10 wherein the vacuum mechanism prevents droplets of waste fluid from the printhead from contacting the substrate.

13. The printing apparatus of claim 12 wherein the capping station includes a plurality of slots attached to the vacuum mechanism that capture droplets of waste fluid from the printhead.

14. The printing apparatus of claim 10 wherein the vacuum mechanism extracts solvent from the solvent bath.

15. The printing apparatus of claim 3 wherein the immersion position comprises at least one of a vapor immersion position and a solvent immersion position.

16. The printing apparatus of claim 15 wherein the printhead is spot-fired at a frequency in the range of 1 to 1000 Hz in the vapor immersion position.

17. The printing apparatus of claim 1 wherein the capping station includes a rotational adjustment mechanism that positions the solvent bath within a plane parallel to the substrate to align with the printhead.

18. The printing apparatus of claim 17 wherein the rotational adjustment mechanism includes a positioning track that receives one end of the solvent bath.

19. The printing apparatus of claim 1 wherein the blotting station includes a blotting material disposed over a supporting plate that includes a pop-up section.

20. The printing apparatus of claim 19 further comprising a plurality of printheads including the printhead, wherein the pop-up section is adapted to clean fewer than all of the plurality of printheads.

21. The printing apparatus of claim 1 wherein the blotting station includes blotting material stretched between first and second rollers.

22. The printing apparatus of claim 21 wherein the rollers are controlled by at least one motor that maintains a constant tension of the blotting material.

23. The printing apparatus of claim 22 wherein the blotting station comprises at least one encoder for determining an amount of blotting material wound about one of the rollers.

24. The printing apparatus of claim 23 wherein the motor modulates torque output based on an output of the at least one encoder.

25. The printing apparatus of claim 21 wherein the blotting station comprises an edge sensor for determining tracking errors of the blotting material.

26. The printing apparatus of claim 25 wherein the blotting station includes an angle adjustment actuator that correct an angle of the blotting material as the blotting material advances through the blotting station.

27. The printing apparatus of claim 26 wherein the angle adjustment actuator adjusts an angle of one of the rollers.

28. The printing apparatus of claim 1 wherein the blotting station includes a vacuum hood.

29. The printing apparatus of claim 1 further comprising a translation stage that moves at least one of the blotting station and the capping station relative to the printhead.

30. The printing apparatus of claim 29 wherein the translation stage comprises a linear stage.

31. A printing apparatus comprising:

a printhead for depositing printing fluid onto a substrate;

a stage onto which the substrate is loaded and unloaded; and a maintenance station for the printhead that includes a capping station and a blotting station, wherein the maintenance station is configured to operate while the substrate is being at least one of loaded and unloaded;

wherein the capping station defines at least one solvent bath containing solvent and provides for an immersion position and a waste removal position of the solvent both with respect to the printhead.

32. The printing apparatus of claim 31 further comprising a height adjustment device that supports one of the capping station and the blotting station.

33. The printing apparatus of claim 32 wherein the height adjustment device includes a scissor lift mechanism.

34. The printing apparatus of claim 32 further comprising a drop analysis system, wherein the height adjustment device positions one of the capping station and the blotting station relative to the drop analysis system.

35. The printing apparatus of claim 31 wherein the printhead is directly above the solvent bath in the immersion position.

36. The printing apparatus of claim 31 wherein the printhead is laterally displaced with respect to the solvent bath in the waste removal position.

37. The printing apparatus of claim 31 wherein the printhead is immersed in solvent vapors from the solvent bath in the waste removal position.

38. The printing apparatus of claim 31 further comprising a tray that captures waste fluid from the printhead.

39. The printing apparatus of claim 38 wherein the waste fluid includes the solvent.

40. The printing apparatus of claim 38 wherein the waste fluid includes the printing fluid.

41. The printing apparatus of claim 38 further comprising a vacuum mechanism that extracts the waste fluid.

42. The printing apparatus of claim 41 wherein the printhead is spot-fired at a frequency in the range of 1 to 1000 Hz in the waste removal position.

43. The printing apparatus of claim 41 wherein the vacuum mechanism prevents droplets of waste fluid from the printhead from contacting the substrate.

44. The printing apparatus of claim 43 wherein the capping station includes a plurality of slots attached to the vacuum mechanism that capture droplets of waste fluid from the printhead.

45. The printing apparatus of claim 41 wherein the vacuum mechanism extracts solvent from the solvent bath.

46. The printing apparatus of claim 31 wherein the immersion position comprises at least one of a vapor immersion position and a solvent immersion position.

47. The printing apparatus of claim 46 wherein the printhead is spot-fired at a frequency in the range of 1 to 1000 Hz in the vapor immersion position.

48. The printing apparatus of claim 31 wherein the capping station includes a rotational adjustment mechanism that positions the solvent bath within a plane parallel to the substrate to align with the printhead.

49. The printing apparatus of claim 48 wherein the rotational adjustment mechanism includes a positioning track that receives one end of the solvent bath.

50. The printing apparatus of claim 31 wherein the blotting station includes a blotting material disposed over a supporting plate that includes a pop-up section.

51. The printing apparatus of claim 50 further comprising a plurality of printheads including the printhead, wherein the pop-up section is adapted to clean fewer than all of the plurality of printheads.

52. The printing apparatus of claim 31 wherein the blotting station includes blotting material stretched between first and second rollers.

53. The printing apparatus of claim 52 wherein the rollers are controlled by at least one motor that maintains a constant tension of the blotting material.

54. The printing apparatus of claim 53 wherein the blotting station comprises at least one encoder for determining an amount of blotting material wound about one of the rollers.

55. The printing apparatus of claim 54 wherein the motor modulates torque output based on an output of the at least one encoder.

56. The printing apparatus of claim 52 wherein the blotting station comprises an edge sensor for determining tracking errors of the blotting material.

57. The printing apparatus of claim 56 wherein the blotting station includes an angle adjustment actuator that correct an angle of the blotting material as the blotting material advances through the blotting station.

58. The printing apparatus of claim 57 wherein the angle adjustment actuator adjusts an angle of one of the rollers.

59. The printing apparatus of claim 31 wherein the blotting station includes a vacuum hood.

60. The printing apparatus of claim 31 further comprising a translation stage that moves at least one of the blotting station and the capping station relative to the printhead.

61. The printing apparatus of claim 60 wherein the translation stage comprises a linear stage.

* * * * *